United States Patent [19]

Matsushita

[11] Patent Number: 4,803,469

[45] Date of Patent: Feb. 7, 1989

[54] FIRE ALARM SYSTEM

[75] Inventor: Eiji Matsushita, Yamato, Japan

[73] Assignee: Hochiki Corporation, Tokyo, Japan

[21] Appl. No.: 884,976

[22] Filed: Jul. 14, 1986

[30] Foreign Application Priority Data

Jul. 18, 1985 [JP] Japan ..... 60-158569

[51] Int. Cl.[4] ..... G08B 17/06

[52] U.S. Cl. ..... 340/577; 340/511; 340/628

[58] Field of Search ..... 340/511, 514, 870.21; 364/550, 557, 555, 178, 551

[56] References Cited

U.S. PATENT DOCUMENTS

| | | | |
|---|---|---|---|
| 4,151,522 | 4/1979 | Yamauchi | 340/628 X |
| 4,459,583 | 7/1984 | van der Walt et al. | 340/511 |
| 4,514,720 | 4/1985 | Oberstein et al. | 340/511 |
| 4,517,554 | 5/1985 | Moser et al. | 340/511 |
| 4,644,331 | 2/1987 | Matasushita et al. | 340/628 |
| 4,665,390 | 5/1987 | Kern et al. | 364/551 X |

*Primary Examiner*—Joseph A. Orsino
*Assistant Examiner*—Annie H. Chau
*Attorney, Agent, or Firm*—Lackenbach Siegel Marzullo & Aronson

[57] ABSTRACT

A fire alarm system which comprises one or more detecting sections for detecting a change in the surrounding phenomena due to a fire in an analog form; a storing section for storing the analog data output from the detecting section or sections; a level comparing section for comparing a data level represented by present instantaneous analog data output from the detecting section or sections and a predetermined level; fire judging instructing section which extracts a plurality of data stored during a predetermined period of time back to from the time when a comparison signal is obtained from the level comparing section, calculates a change amount between the respective extracted data and generates an output for initiating the calculation when the number of the calculated change amounts exceeding a predetermined amount exceeds a predetermined number; and a fire judging section for receiving the data stored in the storing section in response to the signal from the comparing section and/or fire judging instructing section to judge a fire.

18 Claims, 5 Drawing Sheets

FIRE ALARM SYSTEM

This invention relates to a fire alarm system adapted to judge a fire on the basis of analog data from analog detectors which detect a change in surrounding conditions such as a temperature, a smoke density or the like, caused due to a fire.

Recently, many studies have been done to develop an analog fire alarm system which is capable of judging a fire on the basis of analog detection data.

This type of analog fire alarm system generally has such a formation that a plurality of analog fire detectors for detecting, in an analog form, a change in surrounding conditions such as a temperature or a smoke density caused due to a fire are installed at respective supervisory regions to input analog detection data from the respective analog detectors into a central signal station. Upon receipt of the analog detection data from the respective analog detectors, the central signal station compares the level of the analog detection data with a preset calculation starting level and actuates a predictive calculation means to start predictive calculation when the level of the analog detection data exceeds the calculation starting level.

More specifically, when one of the analog detectors outputs analog detection data of a high level, the predictive calculation starts only for the analog detector which has output the analog detection data exceeding the calculation starting level so as to make prompt predictive fire determination. The predictive calculation means in the central signal station carries out the predictive calculation of a fire according to polynominal approximation. In normal supervision conditions wherein the level of the analog detection data is lower than the calculation starting level, the actuation of the predictive calculation means is inhibited to reduce the work to be imposed on the predictive calculation means for enabling effective calculation operation.

However, when a transitory noise due to, for example, smoke of cigarette, or an impact noise such as a shot noise accompanying the analog detection is produced it will be contained in the analog detection data. The central signal station receives analog detection data containing such a noise, and if the level of the data exceeds the preset calculation starting level, the predictive calculation means is immediately actuated to start the predictive calculation, regardless of data level rise due to a noise.

In the meantime, another analog detector may possibly detect a real fire and transmit fire data. In this case, the central signal station undertakes to carry out the predictive calculation for the analog detector which has transmitted false fire data due to a noise prior to the predictive calculation for said another analog detector which has transmitted real fire data. Thus, not only the work of the predictive calculation means is increased, but time is wasted until the predictive calculation is initiated for the urgent real fire data, thus delaying the fire alarming.

OBJECT AND SUMMARY OF THE INVENTION

The present invention has been made with a view to obviating the problems involved in the conventional fire alarm system as described above and it is an object of the present invention to provide a fire alarm system which is capable of promptly and accurately judging a fire on the basis of analog fire detection data without any influence by noises and other false signals.

To attain the object, the present invention features a fire alarm system which comprises one or more detecting sections for detecting a change in the surrounding phenomena due to a fire in an analog form; a storing section for storing the analog data output from the detecting section or sections; a level comparing section for comparing a data level represented by present instantaneous analog data output from the detecting section or sections and a predetermined level; and producing a comparison signal when such level is exceeded; fire judging instructing section which extracts a plurality of the data stored in the storing section during a predetermined period of time preceding when a comparison signal is obtained from the level comparing section, calculates the change amounts between the respective extracted data, and generates an output signal for initiating the calculation when the number of the calculated change amounts exceeding a predetermined amount exceeds a predetermined number; and a fire judging section for making a fire judgment calculation from the data stored in the storing section in response to a signal from the comparing section and/or from the fire judging instructing section.

In the fire alarm system of the present invention, when the level of the present instantaneous analog data from the analog detectors exceeds a predetermined level, the fire judging section may be actuated directly based on the output from the comparing section. Alternatively the fire judging instructing section will be actuated by another output from the comparing section to extract a plurality of data stored during a predetermined period of time preceding the present time, calculate the change amounts between the respective extracted data, and instruct the fire judging section to initiate calculation when the number of data indicative of a change amount exceeding a predetermined amount is determined to exceed a preset number.

With this formation, even if a transitory noise due to smoke of a cigarette etc. or an impact noise such as a shot noise accompanying the analog detection is caused, the fire judging section will never be actuated by such a noise. On the other hand, when abnormal data is obtained, the fire judgement can be surely actuated.

DESCRIPTION OF PREFERRED EMBODIMENT

Figure 1:
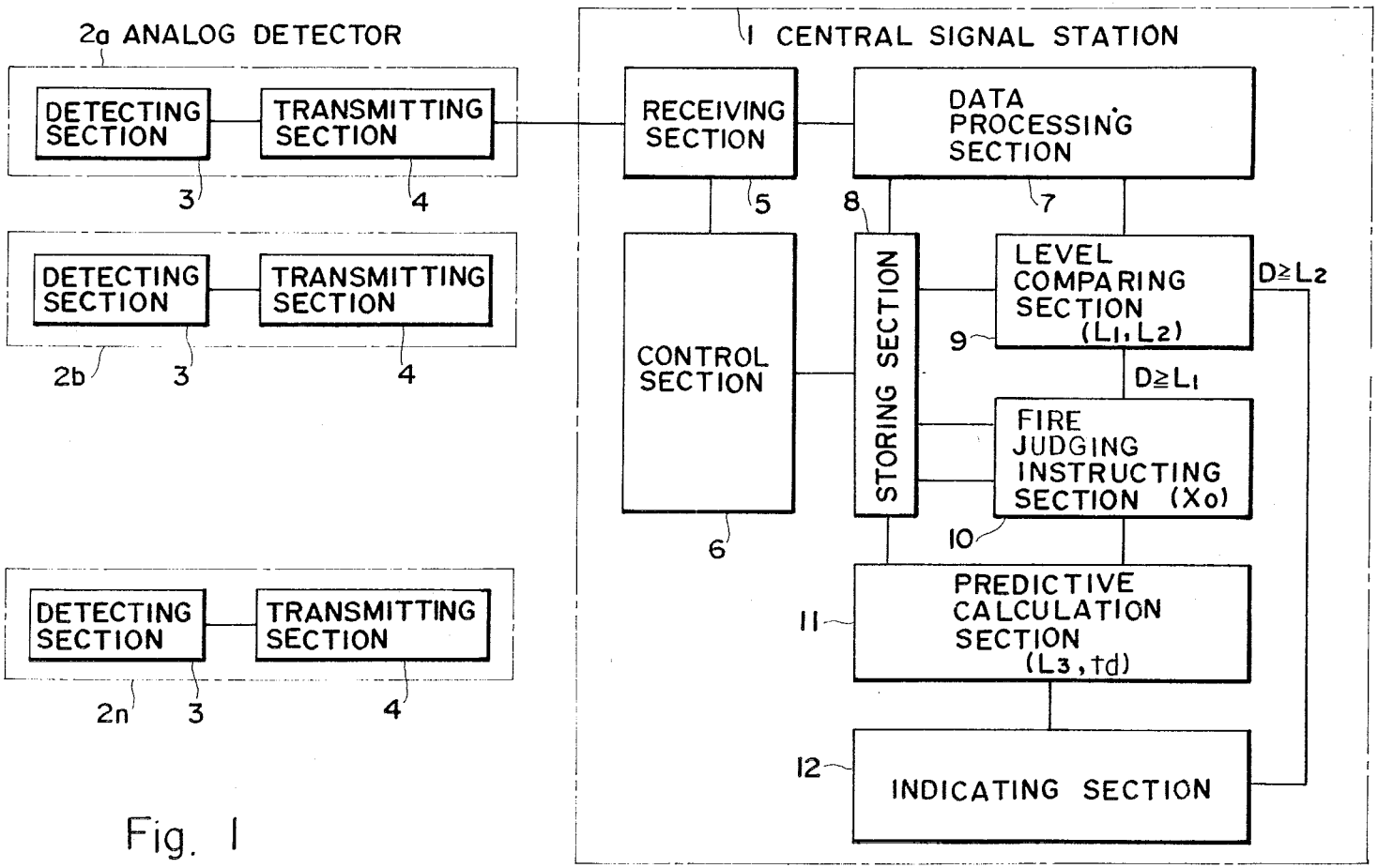
FIG. 1 is a block diagram illustrating a first embodiment of the present invention.

The embodiments of the present invention will now be described referring to the drawings.

FIG. 1 is a system diagram of a first embodiment of the present invention.

The configuration of the system will first be described. 1 is a central signal station and a plurality of analog detectors *2a, 2b, . . . 2n* are connected to the signal station through a signal line. Each of the analog detectors *2a, 2b, . . . 2n* includes a detecting section 3 for detecting, in an analog form, a change in the surrounding phenomena such as a temperature, smoke density, etc. caused due to a fire and a transmitting circuit section 4 for transmitting detection data from the detecting section 3 to the central signal station 1.

The transmitting circuit 4 included in the respective analog detector *2a, 2b, . . . 2n* is allotted with an address, respectively. The transmitting section 4 counts calling pulses from the central signal station 1 and transmits the analog detection data in a current mode during an idle time, i.e. an interval between the calling pulses, when the transmitting section 4 determines the counted value agrees with its own address.

The configuration of the central signal station 1 will now be described. 5 is a receiving section which generates calling pulses for the analog detectors *2a, 2b . . . 2n* in response to a calling instruction from a controlling section 6 and gathers the analog detection data from the respective analog detectors *2a, 2b . . . 2n* by polling. The receiving section 5 then converts the gathered analog detection data in the current mode into a digital mode and outputs the A/D converted data to a data processing section 7.

Figure 2:
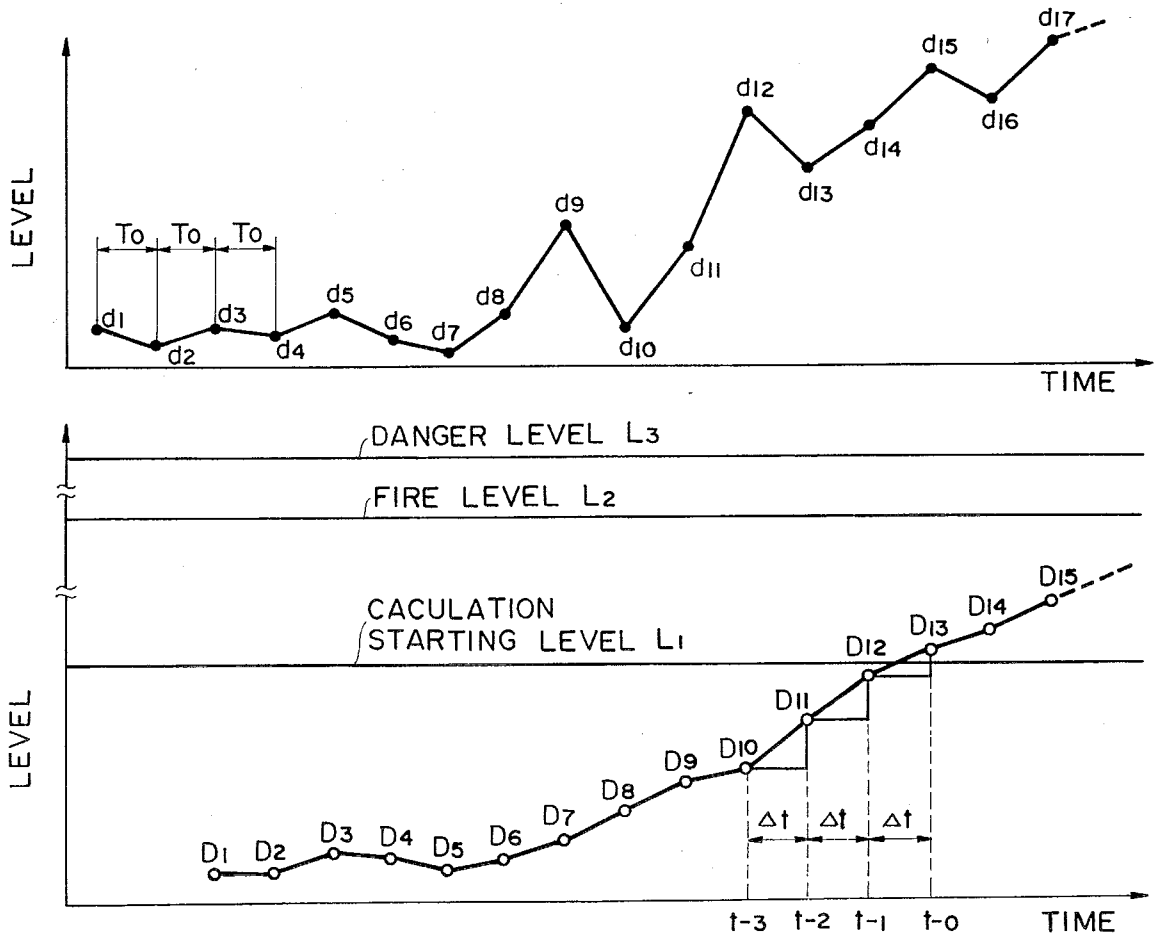
FIG. 2 is explanatory diagrams for illustrating the operation of the embodiment illustrated in FIG. 1.

The data processing section 7 stores the detection data while assigning them with the addresses of the respective analog detectors *2a, 2b . . . 2n* and calculates a moving average from a plurality of the detection data when a predetermined number of data have been stored at the respective addresses. The data processing function of the data processing section 7 will be described referring to FIG. 2. When data d1, d2, d3, d4 . . . are obtained at predetermined time intervals T0 from the receiving section 5 as ashown in FIG. 2(A), the data processing section 7 calculates a moving average whenever three such data have been obtained as shown in FIG. 2(B). More, specifically, the data processing section 7 carries out the following calculations:

$$D1=(d1+d2+d3)/3$$

$$D2=(d2+d3+d4)/3$$

$$D3=(d3+d4+d5)/3 \quad (1)$$

The analog average data D1, D2, D3, D4 . . . thus derived by the moving average calculation are output to a storing section 8 and a level comparing section 9.

In the meantime, the control section 6 supplies a calling instructing signal to the receiving section 5 and a synchronizing signal synchronized with the calling instructing signal to the storing section 8.

The storing section 8 is responsive to the synchronizing signal to store the analog averages data from the data processing section 7 in the respective addresses.

Two threshold levels, i.e., a calculation starting level L1 and a fire level L2 higher than the calculation starting level L1 are predeterminedly set in the level comparing section 9 as shown in FIG. 2(B). Every analog average data D1, D2, D3 . . . obtained from the data processing section 7 is compared with the calculation starting level L1 and the fire level L2, respectively. If a value of a certain analog average data Di exceeds the calculation starting level L1, a comparison signal is output from comparing section 9 to the storing section 8 and the fire judging instructing section 10. However, if a value of the analog average data Di exceeds the fire level L2, a companion signal is output directly from comparing section 9 to an indicating section 12 to produce fire indication immediately without carrying out fire prediction, as will be described in detail later.

A threshold value X0 for determining the starting of the fire judging calculation is set in the fire judging instructing section 10. The plurality of data stored in the storing section 8 during a predetermined period of time preceding when the comparison signal is obtained from the level comparing section 9 are extracted by the fire judging instructing section 10 to calculate the amount of change between the respective data. The fire judging instructing section 10 outputs an instructing signal for instructing the starting of the fire judging calculation to a predictive calculation section 11 when the number of data indicating the change amount exceeding the threshold value X0 exceeds a predetermined number. The discrimination operation by the fire judging instructing section 10 will be described more specifically referring to FIG. 2(B). If it is assumed that a comparison signal is obtained from the level comparing section 9 at the present time t0 as shown in FIG. 2(B), the calculation starting instructing section 10 extracts from storing section 8 the analog data D10, D11, D12 and D13 stored over a predetermined period of time back to a time t−3 from the present time T0. The fire judging instructing section 10 then calculates the following differential values as change amounts between the respective stored data:

$$x1=\Delta(D11-D10)/\Delta t$$

$$x2=\Delta(D12-D11)/\Delta t \quad (2)$$

$$x3=\Delta(D13-D12)/\Delta t$$

After the change amounts x1, x2 and x3 have been calculated, it is determined whether each of the change amounts x1, x2 and x3 exceeds the threshold value X0 or not. If at least two of the three change amounts x1, x2 and x3 exceed the threshold value X0, a signal is output to the the storing section 8 and the predictive calculation section 11 to instruct the initiation of the predictive calculation.

When the instructing signal is obtained from the fire judging instructing section 10, the predictive calculation section 11 carries out the calculation for fire prediction by linear or quadratic or higher-order polynominal functional approximation according to the method of least squares or difference calculus on the basis of the stored data from the storing section 8. More particularly, a danger level L3 higher than the fire level L2 is set in the predictive calculation section 11 so that a time required to reach the danger level L3 is predictively calculated on the basis of the stored data from the storing section 8. When the calculated time is shorter than the preset value, namely, when it is predicted to reach the danger level L3 within a predetermined time td, it is determined to be a fire and an indicating section 12 is driven to instruct fire indication.

The operation of the embodiment illustrated in FIG. 1 will now be described referring to FIG. 2.

As shown in FIG. 2(A), when the data d1, d2, d3 . . . are input to the data processing section 7 from the receiving section 5 every predetermined time T0, moving averages are calculated for every three data. The level comparing section 9 makes comparison with the calculation starting level L1 whenever the average analog data D1, D2, D3 . . . derived by the moving average processing are obtained from the data processing section 7 as shown in FIG. 2(B). If the analog average data D13 obtained from the data processing section 7 at the present time exceeds the calculation starting level L1, a comparison signal is output to the fire judging instructing section 10. The fire judging instructing section 10 extracts the analog data D10, D11, D12 and D13 during the predetermined period of time back to the time t−3 from the present time t0 from the storing section 8. The change amounts x1, x2 and x3 between the respective extracted data are calculated as shown in the formulae (2). If the change amounts x1 and x2 are larger than the threshold value X0 and the change amount x3 is less than the threshold value X0, these may be expressed by:

$$x1 > X0$$
$$x2 > X0 \qquad (3)$$
$$x3 < X0$$

When two or more of the three change amounts x1, x2 and x3, i.e., x1 and x2 exceed the threshold value X0 as shown above, the initiation of the predictive calculation is instructed to the storing section 8 and the predictive calculation section 11. Although the predictive calculation is instructed when at least two of the three change amounts exceed the threshold value X0 in the present embodiment, the predictive calculation may be instructed when three of five change amounts exceed the threshold value or also when two successive amounts exceed the threshold value. The rate may be suitably selected according to the conditions of the place where the detector is installed.

Further in the above embodiment the difference between the two successive analog data is calculated for calculating the changing amount of analog data Di, the difference can be calculated using some data which are not adjoined each other in time, for example for every predetermined number such as fifth of data.

More further in the above embodiment it is determined as fire when the data level is predicted to reach the danger level L3 which is higher than the fire level L2 in the predetermined time td. However the fire prediction can be carried out by direct calculation of the time td to reach the danger level L3 by using the linear or quadratic or higher-order polynominal functional approximation in the predictive calculation section 11. And the fire level and the danger level can be set separately, as described, or they can be set as the same level in accordance with the setting condition of the detectors.

Figure 3:
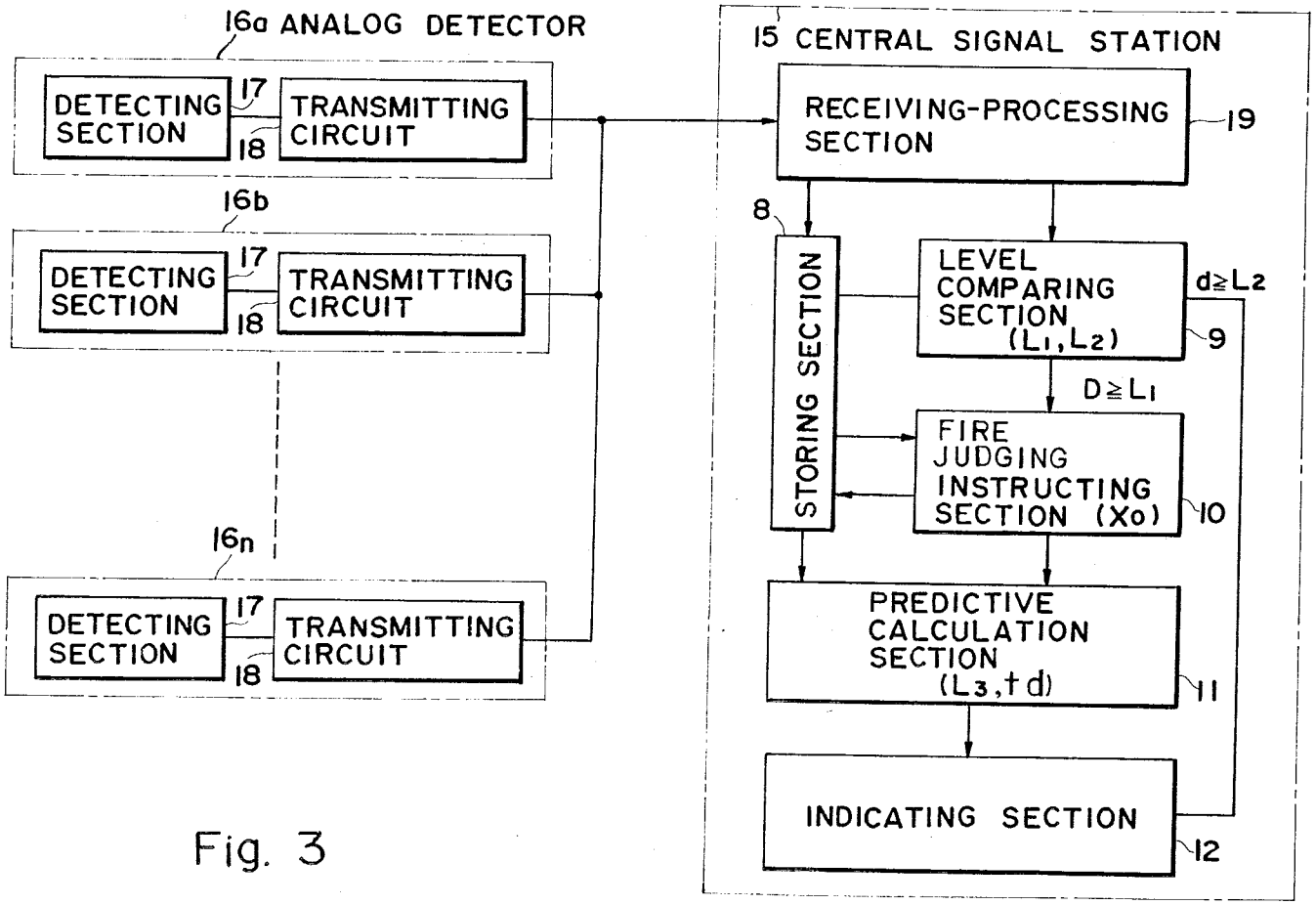
FIG. 3 is a block diagram illustrating another embodiment of the present invention.

FIG. 3 is a block diagram of another embodiment of the present invention. In this embodiment, the analog detection data from the analog detector is used, without being further processed, as analog data to be compared with the calculation starting level L1. The change amount between the respective stored data is calculated in terms of a simple level difference and the predictive calculation is started when data indicative of a level difference larger than the predetermined value are obtained successively.

More particularly, a plurality of analog detectors 16*a*, 16*b*, . . . 16*n* are connected to a signal line derived from a central signal station 15. Each of the analog detectors 16*a*, 16*b*, . . . 16*n* is provided with a detecting section 17 for detecting a smoke density or a temperature due to a fire in an analog form and a transmitting circuit section 18 for transmitting the detection data from the detecting section 17 to the central signal station 15. The transmitting circuit section 18 includes an A/D converting circuit. The transmitting circuit section 18 transmits the analog detection data converted into a digital form, by time division, every predetermined period of time preliminarily allotted, to the central signal station 15 together with its own address.

A receiving-processing section 19 comprises the receiving section 5 and the control section 6 as illustrated in FIG. 1. When the receiving-processing section 19 receives analog detection data from the analog detectors 16*a*, 16*b* . . . 16*n* which have been converted into digital forms, it discriminates the addresses contained in the analog data to instruct a storing section to store the data for the respective addresses. The receiving-processing section 19 outputs the analog detection data converted into the digital form, i.e. analog data to a level comparing section 9.

The level comparing section 9 compares the analog data obtained from the receiving-processing section 19 with a calculation starting level L1. The level comparing section 9 outputs a signal for immediately instructing fire indication to an indicating section 12 when the analog data exceeds a fire level L2.

Figure 4:
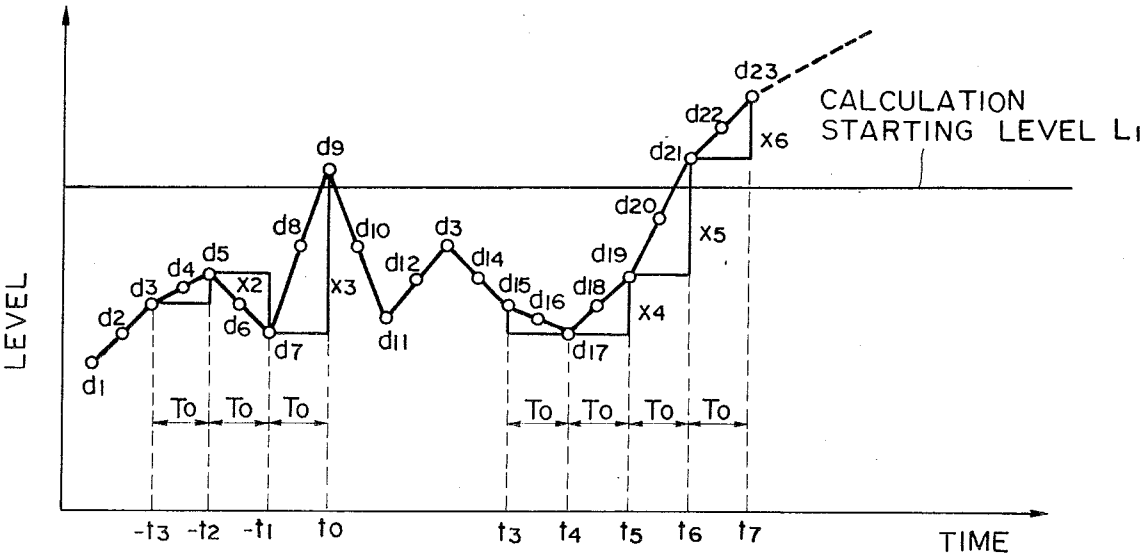
FIG. 4 is an explanatory diagram illustrating the operation of the embodiment illustrated in FIG. 3.

When a fire judging instructing section 10 receives a comparison signal from the level comparing section 9, it determines the initiation of the predictive calculation on the basis of the stored data from the storing section 8. The determination operation of the calculation starting instructing section 10 will now be described referring to FIG. 4. Data d3, d4, d5, d6, d7, d8 and d9 stored during a predetermined period of time back to a time t3 from the present time t0 when the comparison signal is obtained from the level comparing section 9 are extracted from the storing section 8. Then, level differences between every other data are calculated as change amounts.

$$x1 = d5 - d3$$
$$x2 = d7 - d5 \qquad (4)$$
$$x3 = d9 - d7$$

The level difference may alternatively be a difference between consecutive stored data. This may be determined taking a time interval between detection times of the analog detectors 16*a*, 16*b*, . . . 16*n*.

As shown above, the change amount x1 is calculated in terms of level difference between analog data d5 and d3, the change amount x2 in terms of level difference between the analog data d7 and d5 and the change amount x3 in terms of level difference between the analog data d9 and d7. The thus calculated change amounts x1, x2 and x3 are compared with a preset threshold value X0.

$$x1 > X0$$
$$x2 < X0 \qquad (5)$$
$$x3 > X0$$

When the change amount x1 is larger than the threshold value X0, the change amount x2 is smaller than the threshold value X0 and the change amount x3 is larger than the threshold value X0, the initiation of the predictive calculation is inhibited because the data indicative of the change amounts larger than the threshold value X0 are not obtained successively.

Even if analog data d21, d22 and d23 exceeding the calculation starting level L1 are obtained successively after fire monitoring has been further continued, data indicative of change amounts larger than the predetermined amount are not successively obtained based on the stored data extracted during the respectively predetermined periods of time, at the times when the analog data 21 and 22 are obtained. Therefore, the inhibition of the initiation of the predictive calculation to the calculation section 11 are still maintained.

At a time t7 when the analog data d23 is obtained, the change amounts x4, x5 and x6 are calculated based on the stored data during the predetermined period of time back to from the time t7 to obtain the following results:

$$x4 > X0$$
$$x5 > X0 \qquad (6)$$
$$x6 > X0$$

When the change amounts x4, x5 and x6 exceed the threshold value X0, respectively as shown above (6), the initiation of the predictive calculation is instructed to the storing section 8 and the predictive calculation section 11 since the change amounts exceeding the threshold value are obtained successively. Upon receipt of the instruction signal from the fire judging instructing section 10, the predictive calculation section 11 starts the predictive calculation by the polynominal approximation on the basis of the stored data from the storing section 8. When fire determination is made, the indicating section 12 is driven to instruct fire indication.

Although it can be set to start the calculation of the predictive calculation 11 if two successive data exceed the predetermined level the number of data which must successively exceed the preset level can be set freely and is not restricted by the above mentioned number of two.

Figure 5:
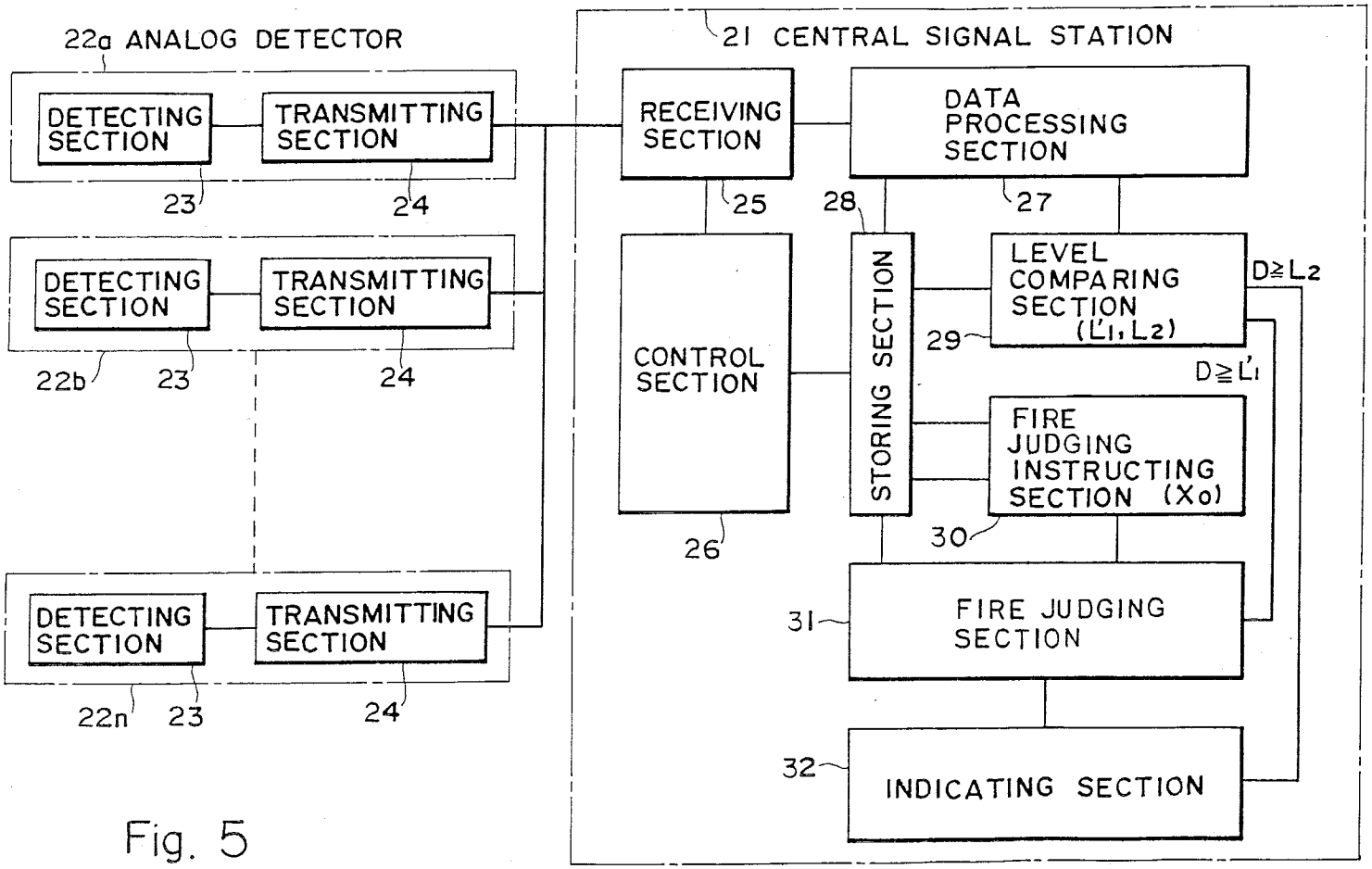
FIG. 5 is a block diagram illustrating further embodiment of the present invention.

FIG. 5 shows an another embodiment. In this embodiment the calculation of change of data is always carried out by using the presently stored data and it is always judged if the number of change amount which overs the predetermined amount exceeds the predetermined number, and also compare the each analog data with the predetermined calculation starting level L1, and the prediction of fire is carried based on both of the above mentioned calculations, while the afore mentioned embodiment is carried the calculation of the change amount between two or more data only when the analog data exceeds the predetermined calculation starting level.

In this embodiment some analog detectors 22*a*, 22*b*, of FIG. 1. And also receiving section 25, control section 26, data processing section 27, storing section 28 and indicating section 32 have the same construction with which are shown in FIG. 1.

The analog data D1, D2, D3, D4 . . . which are calculated as the moving average are stored in the storing section 28 as the same the example of FIG. 1 and the data are to a level comparing section 29.

In the meantime, the control section 6 supplies a calling instructing signal to the receiving section 5 and a synchronizing signal synchronized with the calling instructing signal to the storing section 8.

Two threshold levels, i.e., a calculation starting level L'1 which is the same to the afore mentioned threshold level L1 and a fire level L2 higher than the calculation starting level L'1 are predeterminedly set in the level comparing section 29. And if a value of a certain analog data Di exceeds the calculation starting level L'1, signals are output to the indicating section 32 to instruct fire indication. However if the analog data D1 exceeds the level L'1, the signal is output to the fire judging section 31, not to the fire judging instructing section 30, and it is differ from the embodiment of FIG. 1.

The fire judging instructing section of the first embodiment calculates the change amount when the comparison signal is obtained from the level comparing section. But the fire judging instructing section 30 of this embodiment calculate change amounts between the respective data at when the each analog data is successively stored in the storing section 28. And when the predetermined number of the change amounts are exceed the predetermined number, the fire judging instructing section 30 outputs a signal to the fire judging section 31.

The fire judging section 31 includes a suitable judging device such as AND circuit for judging the fire when the signals are inpur both from the level comparing section 29 and from the fire judging instructing section 30. Under this construction, when the level comparing section 29 compares to find the data level exceed the calculation level, the fire judgement can be done earier than to calculate the change amount of the analog data.

Further the predictive calculation as shown in the embodiments of FIG. 1 and FIG. 3 in this embodiment can be employed to achieve more speedy fire predictive judgement. Although initiation of the predictive calculation is instructed when the number of the data indicative of the change amount exceeding the predetermined amount is larger than the predetermined number in the foregoing embodiments, this arrangement may be applied to the alarming determination for giving an alarm. In this case, when the number of the data indicative of the change amount exceeding the predetermined amount is larger than the predetermined number, a pre-alarm may be given.

Each of the analog detectors includes a detecting section and a transmitting circuit section and the central signal station includes a fire determining function in the foregoing embodiments, but the fire determining function may be incorporated into the analog detector. In this case, only a fire signal is output to the central signal station, so that the calculation processing capacity of the central signal station can be increased.

I claim:

1. A fire alarm system which comprises:

one or more detecting sections for detecting a change in the surrounding phenomena due to a fire and outputting data in an analog mode;

a data processing section receiving said outputted analog data from the detecting section or sections at intervals and smoothing said analog data by interrelating analog data from a plurality of said intervals;

a storing section for storing the smoothed data output from the data processing section;

a level comparing section for comparing a data level represented by present smoothed data output from the detecting section or sections with a preset level and producing a comparison signal when such level is exceeded;

a fire judging instructing section which extracts a plurality of data stored during a predetermined period of time preceding the time when a comparison signal is obtained from the level comparing section, calculates a change amount between the respective extracted data, determines the number of data for which such change amounts exceed a predetermined value, and generates a signal for instructing the start of a fire judgment calculation when the number of such data exceeds a predetermined number; and a fire judging section for making a fire judgment calculation in response to the signal from the fire judging instructing section.

2. A fire alarm system according to claim 1, in which said fire judging section carries out a predictive calculation of fire from the data stored in the storing section in response to the signal from the fire judging instructing section.

3. A fire alarm system according to claim 1, wherein said data processing section for processing the analog data which is provided by said detecting section calculates moving averages of a predetermined number of such data and output the moving averages to the storing section.

4. A fire alarm system according to claim 1, wherein said change amount is calculated in terms of the differences between the respective stored data.

5. A fire alarm system according to claim 4, wherein said respective stored data are consecutive in time.

6. A fire alarm system according to claim 4, wherein said respective stored data are every other data in time.

7. A fire alarm system according to claim 3, wherein said change amount is calculated in terms of the quotient of the difference between the respective stored data and the difference between the detection times of the respective stored data.

8. A fire alarm system according to claim 7, wherein said respective stored data are consecutive in time.

9. A fire alarm system according to claim 7, wherein said respective stored data are every other data in time.

10. A fire alarm system which comprises:

one or more detecting sections for detecting a change in the surrounding phenomena due to a fire and outputting data in an analog mode;

a data processing section receiving said outputted analog data from the detecting section or sections at intervals and smoothing said analog data by interrelating analog data from a plurality of said intervals;

a storing section for storing the smoothed data output from the data processing section;

a level comparing section for comparing a data level represented by present data output from the processing section with a preset level and producing a comparison signal when such level is exceeded;

a fire judging instructing section which extracts a plurality of data stored and calculates a change amount between the respective extracted data and generates an output for instructing the start of a fire judgement when the number of the calculated change amounts exceeding a predetermined amount exceeds a predetermined number; and a fire judging section for judging the fire in response to the comparison signal from the level comparing section and the fire judging instructing section.

11. A fire alarm system according to claim 10, in which said fire judging section carries out a predictive calculation of fire upon receiving the output signal from the level comparing section and the data stored in the storing section in response to the signal from the fire judging instructing section.

12. A fire alarm system according to claim 11, wherein said data processing section for processing the analog data and which is provided between said detecting section and the storing section, calculates moving averages of the data whenever a predetermined number of analog data are input and outputs the moving averages to the storing section.

13. A fire alarm system according to of claim 12, wherein said change amount is calculated in terms of difference between the respective stored data.

14. A fire alarm system according to claim 13, wherein said respective stored data are consecutive in time.

15. A fire alarm system according to claim 13, wherein said respective stored data are every other data in time.

16. A fire alarm system according to claim 12, wherein said change amount is calculated in terms of quotient divided by a difference between the respective stored data and a difference between detection times of the respective stored data.

17. A fire alarm system according to claim 16, wherein said respective stored data are consecutive in time.

18. A fire alarm system according to claim 16, wherein said respective stored data are every other data in time.

* * * * *